US005626421A

United States Patent [19]

Campbell

[11] Patent Number: 5,626,421

[45] Date of Patent: May 6, 1997

[54] BLENDER CONSTRUCTION

[76] Inventor: Craig C. Campbell, 211 Isabella Ave., Washington, N.C. 27889

[21] Appl. No.: 654,078

[22] Filed: May 28, 1996

[51] Int. Cl.[6] ..... B01F 15/06; B01F 7/04

[52] U.S. Cl. ..... 366/147; 366/249; 366/331

[58] Field of Search ..... 366/144, 147, 366/241, 242, 244, 245, 247, 249, 251, 279, 325.1, 325.92, 331

[56] References Cited

U.S. PATENT DOCUMENTS

| | | | |
|---|---|---|---|
| 1,355,137 | 10/1920 | Frick . | |
| 1,540,547 | 1/1925 | Doidge . | |
| 2,563,937 | 8/1951 | Keight | 366/331 |
| 2,600,408 | 1/1952 | Komarek . | |
| 3,090,606 | 5/1963 | Burnet | 366/147 |
| 3,162,428 | 12/1964 | Lodige | 366/279 |
| 3,747,899 | 7/1973 | Latinen et al. | 366/331 |
| 3,964,732 | 6/1976 | Hartley | 366/279 |
| 4,390,285 | 6/1983 | Durr et al. | 366/147 |

*Primary Examiner*—Robert W. Jenkins
*Attorney, Agent, or Firm*—Wallace J. Nelson

[57] ABSTRACT

A blender construction employing a unitary cylindrical body and removable, semicircular segmented, end cap closures wherein a unitary blender body includes an inlet chute at a first end and an exit chute at a second end. A centrally disposed hollow mixing shaft extends through the segmented end caps and is provided with diametrically disposed hollow mixing fingers spaced therealong positioned within the blender body. A high pressure heat exchange fluid source connects the blender, through tubing extending through one of the segmented end caps and, along the interior length of the blender housing. The heat exchange fluid is expelled from openings therein aligned with each of the mixing tool hollow interiors. The blender housing is supported on a platform that also supports the end bearings for the rotating blender shaft. A drive wheel is keyed to the hollow rotating blender shaft at one end thereof to connect with a suitable drive power supply. The removable, semicircular segmented, end caps permit ready assembly, repair and/or removal of the blender interior components without moving the blender housing from its installed site.

20 Claims, 4 Drawing Sheets

BLENDER CONSTRUCTION

FIELD OF THE INVENTION

This invention relates generally to blenders and mixing tools, and relates specifically to a blender construction that may be easily assembled and disassembled for placing in operation and for cleaning and repair.

BACKGROUND OF THE INVENTION

Continuous blenders are well known in the art for applying liquid resin to wood particles or other matrices in the production of particle or fiber board. Conventionally, blenders of this type are made of totally welded heavy gauge metal components. In some of the blenders, access doors are provided to provide limited access to the inside of the blender. Other blenders are provided with "clam-shell" type hinged doors that are generally equal to one-half the diameter of the blender. The access doors permit only limited access to the inside of the blender and result in some difficulty in getting into the blender and with good access to the blending tools. The clam-shell type blenders are difficult to maintain completely sealed and result in leakage of dust from the blending particles during a blending operation. Blenders are conventionally made from heavy metal to withstand wear, and often with stainless steel, to withstand changes in acidity and the use of corrosive materials in the blending operation. Prior art blenders normally stay in operative position and orientation throughout the 12–15 year industrial life thereof. Accordingly, most blenders have been constructed and placed in position without considering the possibility of future maintenance or repair being required.

Changes in the particle board industry in recent years have seen the development of larger production plants, requiring larger blenders, and specialization of fiber types and separation. Some blending operations now employ a series of blenders to achieve the final particle board mixture. There is presently a demand for making the face surface of some fiber or particle boards from 100 per cent fines (below 40 mesh and 15 pounds per cubic foot). Fines require and consume more resin that larger wood particles. The physical make-up of the core of this type particle board is made more fluffy and fibrous, by employing fuzzy character material from attrition mills, to thereby give greater core strength after bonding. An advantage of this is that fiber has much more bulk with a lower bulk density of approximately 6 pounds per cubic foot.

As a result of these changing market conditions, many plants now must have two lines of production, one for face (using fines), and one line for core (using fluffy material). Also, the blenders in the respective lines must perform different functions. Some of the blenders employed to blend fines are relatively small in size and content and employ high speed mixing components. Large or long blenders have longer distances between bearings and must be limited to lower RPM speeds, resulting in less stirring and less random particle-to-particle contact. Larger machines also result in greater imbalance, greater vibration on high platforms, with limited work energy being applied to the mixing process result. Small (shorter) blenders have less distance between the bearings and produce less vibrations when employed in a mixing operation. The high speeds of smaller blenders promote more wear on the blending tools and require increased inspection and maintenance.

An exemplary short high speed blender is disclosed in applicant's copending application Ser. No. 08/398,421, filed Mar. 3, 1995 and the subject matter of which is incorporated herein by reference.

It is an object of the present invention to provide a small blender construction that is readily assembled and disassembled to permit frequent inspection and repair of the interior component parts of the blender with a minimum down-time period.

Another object of the present invention is to provide a high quality, sturdy strength, blender construction that permits easy and total access to all internal components.

Another object of the present invention is a high structural strength blender that can be completely sealed from loss of material contained therein during a blending procedure.

A further object of the present invention is to provide a blender that occupies a minimum of space and will readily fit into limited space areas.

SUMMARY OF THE INVENTION

According to the present invention, the foregoing and additional objects are attained by providing a blender, including a unitary cylindrical chambered housing having a first and a second open end, with two removable, segmented, end caps clamped or otherwise sealing these open ends, an inlet opening at the first end, an exit at the second end, and a removable access port disposed in the blender housing to permit access to a small portion of the blender housing interior.

A motor driven, centrally disposed, hollow mixing shaft extends through the blender housing and the end cap closures therefor. A plurality of mixing fingers or tools are removably attached along the length of, and extend essentially perpendicular from, the hollow mixing shaft. The mixing tool members are arranged in diametric pairs and disposed in spaced relationship along the entire length of the mixing shaft portion that is disposed within the cylindrical chambered housing. Each mixing tool member is provided with an angular, multi-face, hollow interior that communicates with the chambered portion of the cylindrical housing. In the preferred embodiment of the present invention, the individual mixing tools are provided with a triangular cross-sectional configuration but mixing tools formed of square, rectangular and diamond cross-sectional areas are equally applicable in the practice of the invention.

A high pressure coolant fluid source is connected to the blender via a conventional rotary joint valve, that does not hinder the rotation of the blender shaft, through tubing extending through one of the end caps and along the interior length of the blender housing. The high pressure coolant fluid is expelled from openings provided in the tubing extending along the interior length of the blender housing. The openings are aligned with each of the mixing tool interiors to maintain the mixing tools at an acceptable temperature during a blending operation. The excess coolant medium is removed from the hollow mixing shaft through a suitable outlet disposed adjacent to the inlet for the coolant fluid conduit. The term "coolant" as used herein is intended to include any cool or hot heat exchange fluid medium such as cooling water, glycol, hot water, hot oil, steam, or gas, for temperature control of the blender parts.

The blender is supported on a suitable platform that also supports the end bearings for the rotating blender shaft. A suitable inlet chute for transferring wood particles to the blender housing is provided at one end of the blender housing and extends through an opening in the blender housing at the entrance end of the blender. An outlet passage is provided at the opposite end of the blender housing adjacent the other end cap and serves to remove the blended wood particles and resin binder therefor. A resin or adhesive conduit, leading from a suitable adhesive source, is provided through the end cap of the blender housing, or through the inlet for the wood particles.

BRIEF DESCRIPTION OF THE DRAWINGS

A more complete appreciation of the invention and many of the attendant advantages thereof will be more readily apparent as the same becomes better understood when considered in reference to the accompanying drawings wherein.

DETAILED DESCRIPTION

Figure 1:
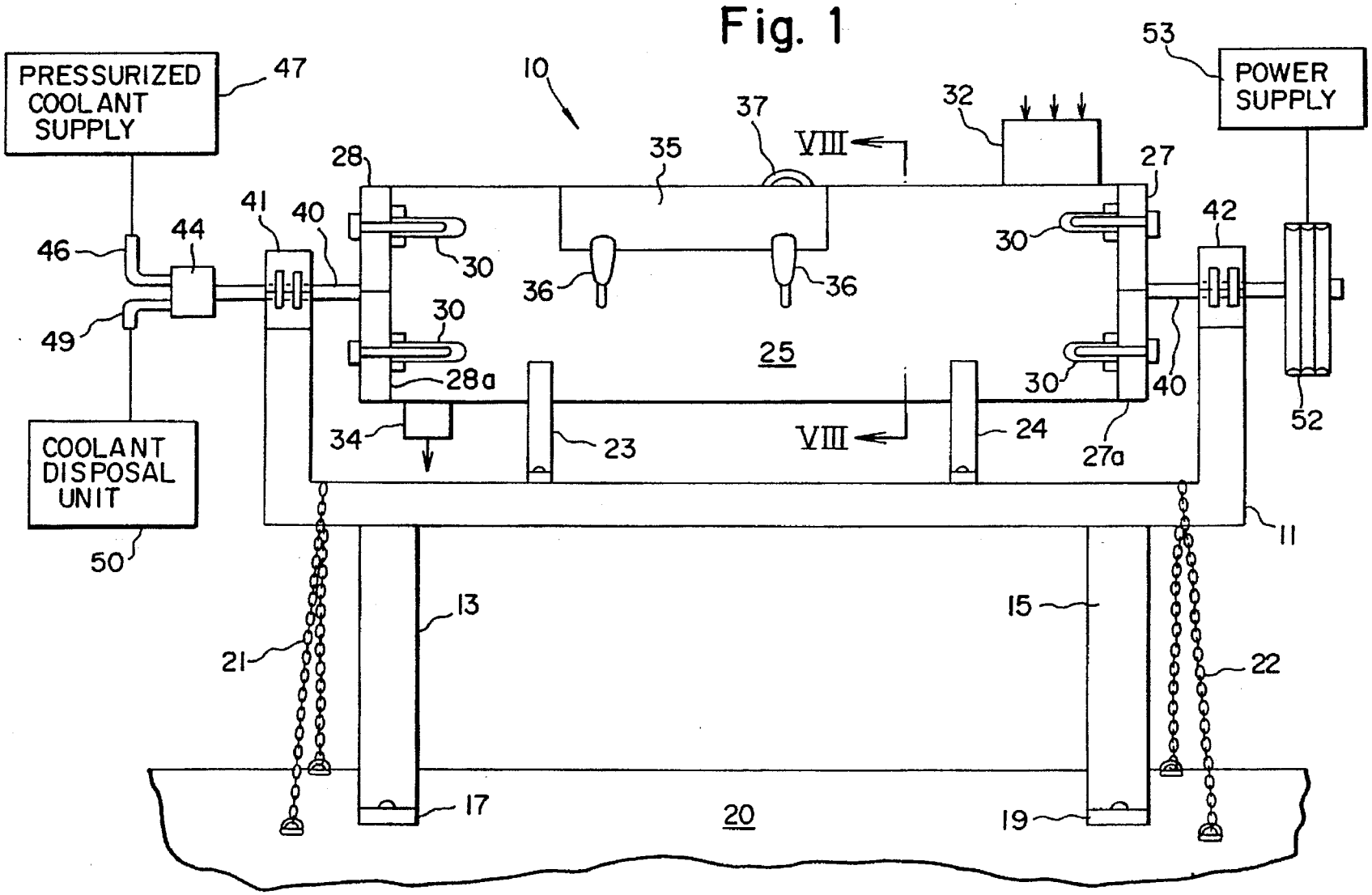
FIG. 1 is a schematic illustration of a preferred embodiment of the blender assembly of the present invention.

Referring now to the drawings, and more particularly to FIG. 1, the blender assembly of the present invention is shown and designated generally by reference numeral 10. Blender assembly 10 includes a U-frame 11 supported by a pair of legs 13, 15 having respective foot braces 17,19. Foot braces 17,19 are bolted via suitable bolts, not designated, to a support platform surface 20. A pair of log chain type supports 21,22 are anchored to platform surface 20 and extend over respective ends of U-frame 11 to provide additional for support therefor.

A pair of curved support brackets 23,24 are integrally secured to, disposed in spaced relationship and vertically extend upward from, the longitudinal arm of U-frame 11 to provide cradle support for unitary, cylindrical chambered blender housing 25.

Blender housing 25 is provided with a pair of end caps formed of halves 27,27*a* and 28, 28*a*, respectively, and sealingly secured thereto by a plurality of lock clamps designated by reference numeral 30. Lock clamps employed in a specific embodiment of the present invention are defined as "pull action toggle clamps with positive latching steel holding caps" and are available as DE-STA-CO clamps and purchased from McMaster-Carr Supply Company, 6100 Fulton Industrial Blvd., Atlanta, Ga. 30336-2852. Additional details of end caps 27,27*a* and 28,28*a* and the locking clamps therefor will be further explained hereinafter.

An inlet 32 is provided at a first end of blender housing 25 and serves to convey the particulate material and binder (resin or other suitable adhesive material) into the blender housing 25. An outlet 34 is disposed at the second end of blender housing 25 and serves to convey the blended materials to a utilization station which may be a board press assembly or to another blender, depending upon the planned utilization of the blended mass. An access door 35 is provided through a portion of the sidewall of blender housing 25 and retained in sealed relationship therewith via a plurality of locking clamps, two of which are shown in FIG. 1 and designated by reference numeral 36. Locking clamps 36 are identical in construction (but may be smaller) to locking clamps 30 employed to secure end caps 27,27*a* and 28,28*a*. An integral support handle 37 is provided on access door 36 to facilitate positioning and removal of the door as needed to inspect the interior of blender housing 25, as will be further explained hereinafter.

A blender mixing shaft 40, having respective first and second ends, rotatably extends through blender housing 25, the respective end caps 27,27*a* and 28,28*a*, and is cradled in respective bearing housings 41,42. Bearing housings 41,42 are formed of split sleeve construction with the sleeve thereof being bolted together and one of the split sleeves of each housing being attached to a vertical support of U-frame 11. A coolant medium connection box 44 is secured to the second end of mixing shaft 40 to permit relative rotation therebetween. A coolant inlet conduit 46 leads from a suitable pressurized coolant supply source 47 into coolant housing 44 to supply pressurized coolant fluid to the interior of mixing shaft 40, as will be further explained hereinafter. A coolant outlet conduit 49 extends from coolant connection box 44 and serves to transfer expended coolant from the interior of mixing shaft 40 to a suitable coolant disposal unit 50. The term "coolant" as used herein is intended to include any heat exchange medium such as, but not limited to, cooling water, glycol, hot water, hot oil, steam, or gas, for temperature control of the blender parts and blended matrix.

A drive pulley 52 is keyed in a conventional manner to the first end of mixing shaft 40. Drive pulley is driven at the desired RPM speed by a suitable power supply source 53 connected thereto in a conventional manner such as by belt(s) or gears and not further illustrated or explained herein in the interest of brevity.

Figure 2:
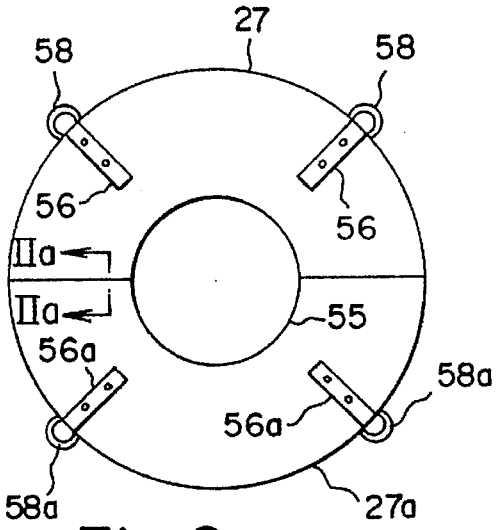
FIG. 2 is a schematic illustration of one of the end caps for the blender assembly of FIG. 1.
Figure 2A:
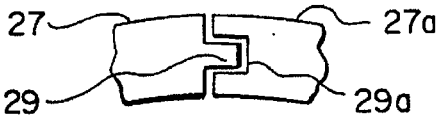
FIG. 2A is a sectional view as seen along line IIA—IIA of FIG. 2.

Referring now more particularly to FIGS. 2 and 2A, further details of end cap 27,27*a* and 28,28*a* are shown. As shown therein, end cap portions 27,27*a* are semi-circular segments and provided with tongue and groove mating surfaces 29,29*a* respectively, along the mating surfaces thereof to form a central opening 55 that serves to receive blender mixing shaft 40 in sealed and rotatable relationship therewith. A plurality of clamp engaging brackets 56,56*a* are secured to the respective top surfaces of end cap segments 27,27*a* by suitable bolts (not designated) or other conventional attachment structure. The ends of each bracket 56,56*a* is provided with respective open eye or receptacle 58,58*a* that serves to receive a hook end 60 (FIG. 3) of each individual lock clamp 30. End cap portions 28,28*a* are of identical construction as end cap portions 27,27*a* and are not further described herein in the interest of brevity.

Figure 3:
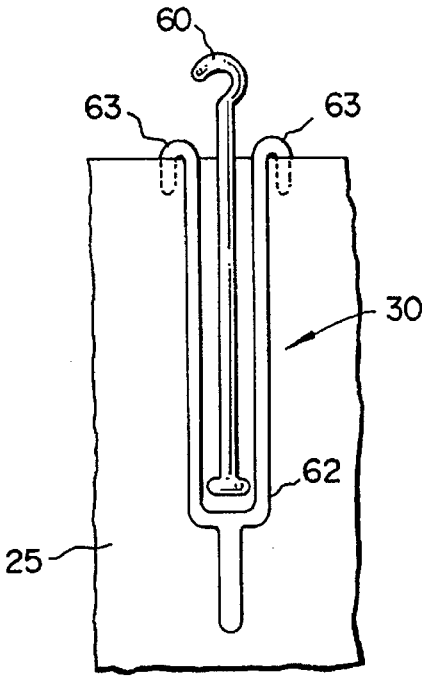
FIG. 3 is a part schematic view of one part of one of the latches employed to hold the end caps and a small access door in sealed relationship to the blender housing.

As shown more clearly in FIG. 3, locking clamp 30 includes the hook end 60 on a shaft that is pivotally connected at its opposite end to a handle structure 62. Handle structure 62 is, in turn, pivotally connected at one end to a bracket 63. Bracket 63 is bolted, bonded, or otherwise conventionally attached to the surface of cylindrical blender housing 25. A suitable spring (not shown) serves to maintain clamp handle 61 in the locked position illustrated until manual manipulation of the handle to release hook 60 from an open eye 58,58*a* (or from the identical eye portions of end cap portions 28,28*a*, not shown).

Figure 4:
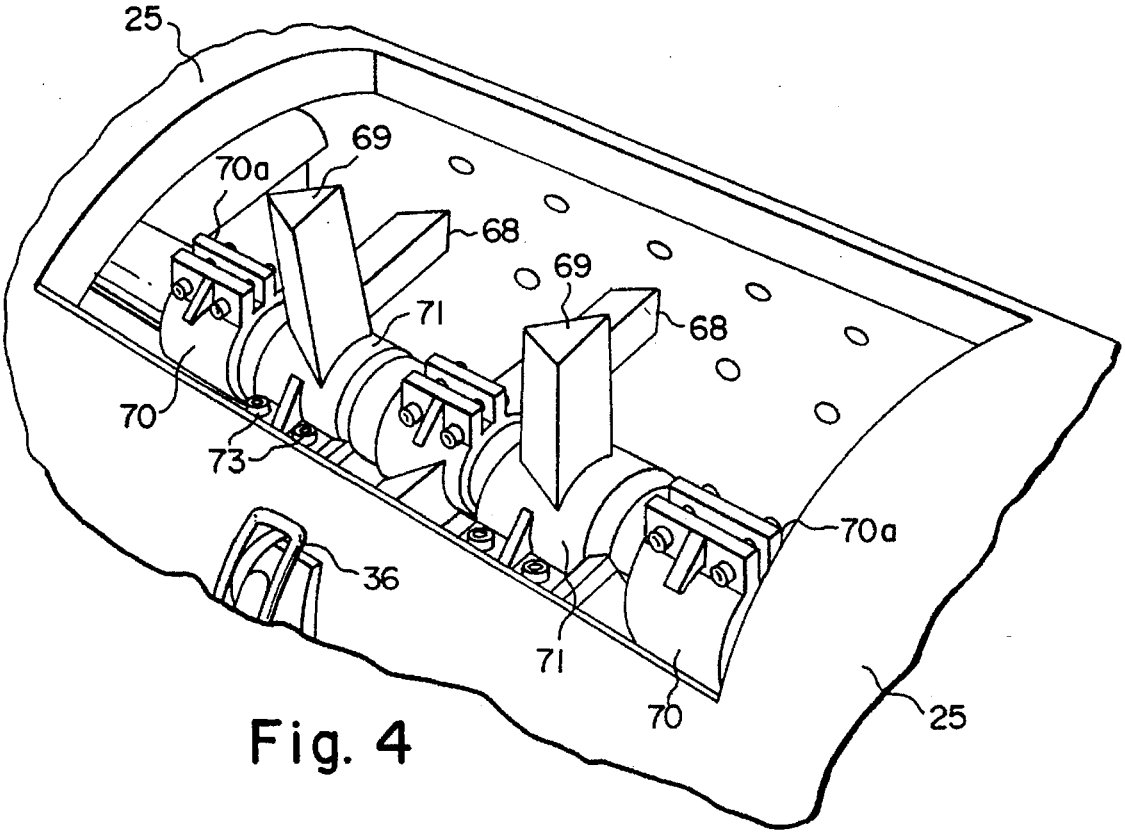
FIG. 4 is a part schematic view of the blender assembly of the present invention with the small access door therefor being removed to expose an interior area of the blender housing and contained components.

Referring now more particularly to FIG. 4, blender housing 25 is shown with access door 35 removed therefrom to expose to view a portion of the housing interior and the included mixing shaft 40 and attached plurality of mixing tools 68 and 69. Although not visible FIG. 4, but clearly shown in FIG 5, each mixing tool 68 is provided with a matching and diametrically opposed identical mixing tool 68*a* and each mixing tool 69 provided with a matching and diametrically opposed identical mixing tool 69*a*. Mixing tools 68,68*a* are integrally formed with suitable respective U-clamps 70,70*a* and mixing tools 69,69*a* are integrally formed with suitable respective U-clamps 71,71*a*. A pair of suitable bolts and nuts 73 are employed to connect each side of paired U-clamps 70,70*a* and 71,71*a* about mixing shaft 25, as will be further explained hereinafter.

Figure 5:
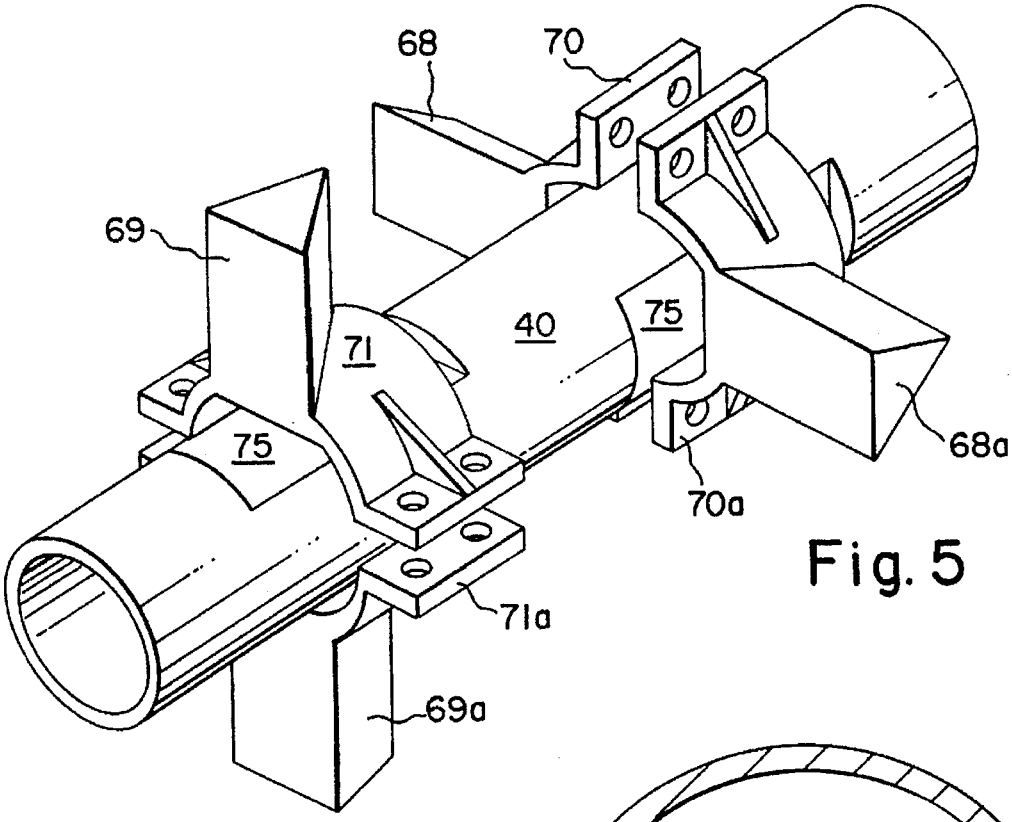
FIG. 5 is a schematic view of a portion of the blender shaft employed in the blender assembly shown in FIG. 1 and illustrating two pairs of the mixing tools to be attached thereto.

As shown more particularly in FIG. 5, for assembly, paired mixing tools 68,68*a* and 69,69*a* and their respective integrally attached U-clamps 70,70*a* and 71,71*a* are disposed about blender mixing shaft 40 in a ninety degree relationship along the length of shaft 40. Each pair of the mixing tool U-clamps are disposed on flat surface areas 75 arranged in diametrically disposed pairs along the axis of mixing shaft 40. In the preferred and illustrated embodiment. Each U-clamp is provided with a flat surface area (not designated) to abut the flat areas 75 on blender mixing shaft 40. Each U-clamp pair 70,70*a* and 71,71*a* is secured together about shaft 40 via four suitable nuts and bolts (not illustrated) extending through suitably provided openings (not designated) provided therein.

In the preferred embodiment illustrated in FIG. 5, each mixing tool 68,68*a* and 69,69*a* is provided with a working area that is triangular in cross section, and has two flat surfaces in contact with the matrix in a blender when in use. The attachment bolts for the U-clamp pairs are omitted in this FIG for purposes of clarity. Tools 68,68*a* and 69,69*a* are also hollow and suitable for passage of an internal heat exchange medium such as cooling water, glycol, hot water, hot oil, steam, or gas, for temperature control thereof, as will be further explained hereinafter. The orientation of the individual tool apex, relative to that of a plane taken perpendicular through the tool center and the longitudinal axis of the attached mixing shaft 40, provides action in conveying and mixing simultaneously in a blender for a variety of matrices including plastics, wood chips or particles, sand, liquid-liquid, liquid-solid and solid-solid blends. This tool orientation is fixed when fabricated. To vary the orientation of the various tools within blender housing 40, replacement tools having the desired orientation may be employed.

Figure 6:
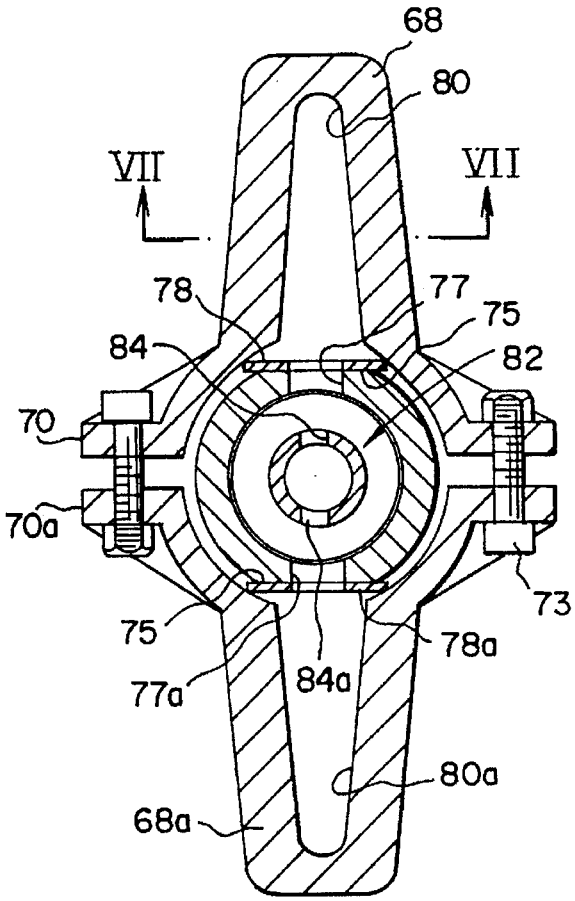
FIG. 6 is a sectional view taken through one of the pairs of tools and the blender shaft shown in FIG. 5.

Referring to FIG. 6, a sectional view of a pair of the assembled, oppositely disposed, mixing tools 68, 68*a* and their respective integral U-clamps 70,70*a* as secured about mixing shaft 40 (illustrated in FIG. 5), is shown. The oppositely disposed flat areas 75 on shaft 40 are provided with openings 77,77*a* therein leading into the interior of shaft 40 and merging with openings (not designated) provided within the flat portions of U-clamps 70,70*a* and which lead into the interior of tools 68,68*a*.

Compressible fluid seal(s) 78 (and 78*a*) are provided between mixing tools 68,68*a* and the respective flat areas 75 on mixing shaft 40 to prevent any exterior coolant leakage therebetween during a mixing operation, as will be further explained hereinafter. In a specific embodiment, fluid seals 78,78*a* are formed of suitable die-cut rubber pads and are each provided with a central opening to provide communication between the interior of mixing housing 40 and the hollow interior of the adjacent mixing tool 68,68*a* (as well as tools 69,69*a* shown in FIG. 5). A centrally disposed coolant conduit 82 is provided fixed within mixing shaft 40 and rotates therewith during a mixing operation. Coolant conduit 82 is provided with paired diametrically disposed openings 84,84*a* (see also FIG. 9) to facilitate the movement of pressurized fluid coolant from coolant conduit 82 into the interior of the mixing tools 68,68*a* and 69,69*a*.

Figure 7:
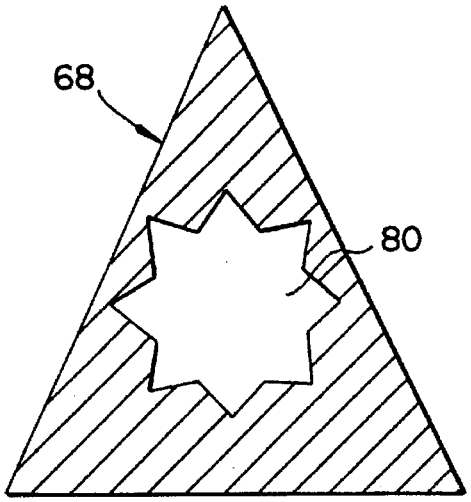
FIG. 7 is a sectional view of one of the paired mixing tools as taken along lines VII—VII of FIG. 6.

FIG. 7 shows a cross sectional area of one of the mixing tools 69 and illustrates the hollow interior surface area 80 provided therein. Hollow interior surface area 80 is provided with a star or other angular surface area to provide an increased or greater surface area therein than would be provided with a circular or even surface area. This angular, or uneven, surface area 80 increases the effectiveness of the coolant fluid circulated therein.

Figure 8:
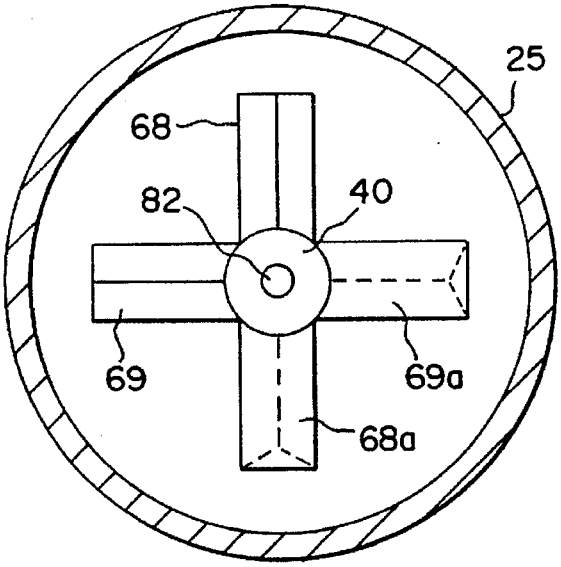
FIG. 8 is a schematic, part sectional, view of the blender housing, blender shaft and attached mixing tools, as seen along line VIII—VIII of FIG. 1.

Referring to FIG. 8, a part sectional view of the assembled mixing tools 68,68*a* and 69,69*a* on mixing shaft 40 is shown as looking along line VIII—VIII of FIG. 1 when the assembled tools and shaft are disposed within blender housing 25.

Figure 9:
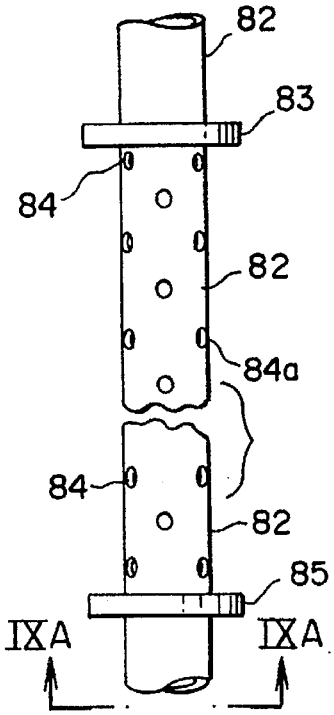
FIG. 9 is a part schematic view of the coolant inlet tube and the closure disk and end spacer therefor employed within the shaft of the blender assembly shown in FIG. 1.

Referring more particularly to FIG. 9, coolant conduit 82 is provided with a solid end closure disk 83 and a spoked spacer disk 85. Closure disk 83 and spoked spacer disk 85 are spaced axially along the length of conduit 82 a distance substantially equal to the length of blender housing 25. Closure disk 83 is of essentially the same exterior diameter as the inside diameter of mixing shaft 40 and is provided with a sealing peripheral surface that serves as a seal therefor to contain the pressurized fluid flowing through coolant conduit 82 within the mixing shaft 40. Spoked spacer disk 85 is secured to mixing shaft 40 spaced from closure disk 83 a distance equal to the length of blender housing 25 and is disposed adjacent the other end thereof at a point where mixing shaft 40 exits blender housing 25. Spoked spacer disk 85 is provided with a plurality of radial spokes 86 extending from an inner rim 87 thereof to the exterior circumference of disk 85.

Figure 9A:
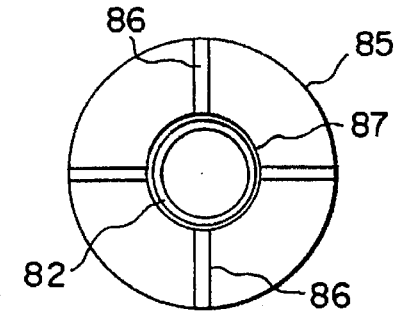
FIG. 9A is an end view of the coolant inlet tube and spoked end spacer therefor as looking along line IXA—IXA of FIG. 9.

As shown more clearly in FIG. 9A, spokes 86 serve to maintain the exterior rim 87 of disk 85 against the inside surface of mixing shaft 40 to maintain the spacing of coolant conduit 82 from the interior surface of shaft 40 and to permit the coolant received from conduit 82 to exit the end of shaft 40 via coolant outlet conduit 49 (FIG. 1). When assembling, closure disk 83 and spoked spacer disk 85 are keyed into blender housing 25 in a conventional manner such that the paired openings 84 in coolant conduit 82 are aligned with the mixing tools 68,68*a* and 69,69*a*. Thus, pressurized fluid flow entering coolant conduit 82 exits through openings 84 in position to direct pressurized coolant flow into the hollow interior of the mixing tools.

Figure 10:
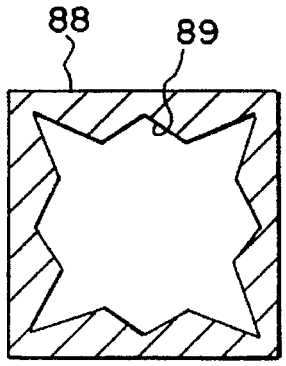
FIG. 10 is a sectional view similar to FIG. 7 and illustrating an alternate configured mixing tool.

Referring to FIG. 10, a sectional view of a square mixing tool configuration 88 similar to FIG. 7 is shown and illustrates a modified angular surface interior 89 therefor.

Figure 11:
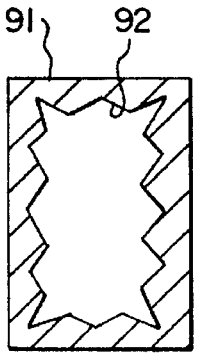
FIG. 11 is a sectional view on another alternate configured mixing tool.

Referring to FIG. 11, a sectional view of a rectangular mixing tool configuration 91 similar to FIG. 10 is shown and illustrates another modified angular surface interior 92 therefor.

Figure 12:
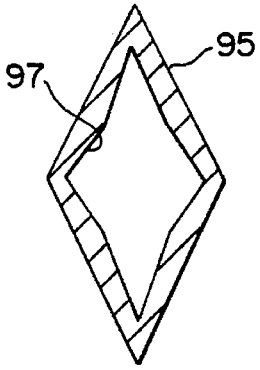
FIG. 12 is sectional view of still another alternate configured mixing tool according to the present invention.

Referring to FIG. 12, a diamond shaped sectional view of a mixing tool configuration 95 similar to FIGS. 10 and 11 is shown and illustrates angular surface interior configuration 97 therefor.

Each embodiment of the mixing tools shown and described herein may be fabricated, welded, or formed from a casting material, from any metal, alloy, composite, or other material suitable for the purposes intended, or having the strength and durable characteristics to perform as intended. In the preferred embodiment, the mixing tools are provided with a working area that is triangular in cross section, and having two flat surfaces in contact with the matrix in a blender when in use. The tools are also hollow and suitable for passage of an internal heat exchange medium such a s cooling water, glycol, hot water, hot oil, steam, or gas, for temperature control thereof during a mixing operation. The orientation of the tool apex, relative to that of a plane taken perpendicular through the tool center and the longitudinal axis of the attached mixing shaft, provides action in conveying and mixing simultaneously in a blender (batch or continuous) for a variety of matrices including plastic, wood chips or particles, sand, liquid-liquid, liquid-solid and solid-solid blends.

In constructing the present invention, blender housing 25 is formed of a unitary section of stainless steel, or equivalent durable material, tubing having the desired thickness and diameter and cut to the desired length. Openings are cut into the side surface of the unitary housing 25 of the dimensions desired for placement of inlet chute 32, outlet chute 34 and access door 35. Inlet chute 32 and outlet chute 34 are also constructed from stainless steel, or similar material, and welded within the respective openings provided therefor in unitary housing 25.

The material cut away from housing 25 to provide the opening therein may also be employed for access door 35. This opening is cut so as to provide angular peripheral faces facing inward toward the center of housing 25 and the removed portion is provided with mating surface angular edges and may be used as access door 35. One or more lift handles 37 are bolted, bonded, or otherwise conventionally secured, to the exterior surface of access door 35 to facilitate placement and removal thereof. Access door 35 is maintained in sealed relationship with blender housing 25 via suitable latch assemblies 36. The size of access door 35 and its opening into housing 25 are adequate to permit visual inspection of the interior of housing 25 and the component parts thereof and in some instances to alleviate any jamming or stoppage experienced during a blending operation. Major repairs or replacement of the mixing tools within housing 25 cannot be performed through the area covered by access door 35.

Blender mixing shaft 40 is also constructed from suitable stainless steel or other durable tubing material with precision flat surfaces 75 being machined thereon and as oppositely disposed pairs and with an opening in each flat surface, as illustrated in FIGS. 5 and 6. Paired hollow mixing tools 68,68*a* and 69,69*a* are cast with their respective support U-clamps 70,71 and bolted, in pairs, to mixing shaft 40 via nuts and bolts 73, as shown in FIGS. 4 and 6. Coolant conduit 82 is constructed from suitable plastic or metal material and positioned within blender mixing shaft 40 with keyed connection of sealing disk 83 and spoked disk 85 with shaft 40 ensuring that openings 84 therein are aligned with the hollow mixing tools 68,68*a* and 69,69*a* for receipt of the pressurized cooling fluid.

End cap halves 27,27*a* and 28,28*a* in a specific embodiment of the invention, are approximately one-inch thick and are secured to close the respective open ends of blender housing 25 via latch assemblies 30. End caps 27,27*a* and 28,28*a* are constructed of any suitable material have the necessary physical and chemical property characteristics required for the intended purpose. These materials include, but are not limited to, metal and metal alloys (such as stainless steel), and durable plastics such as high molecular weight polypropylene, polyethylene, nylon, mylar, and the like. The bottom halves 27*a* and 28*a* of the end caps may be latched to the blender housing 25 prior to insertion of the blender mixing shaft 40 therein. The assembled blender housing and mixing shaft are placed on the bottom section of open bearing housings 41,42 extending from U-frame 11. The top half of bearing housing 41,42 are bolted to the respective bottom halves thereof in a conventional manner, and the top portions 27 and 28 of the end caps are positioned in tongue and groove mating engagement with their respective bottom halves 27*a* and 28*a* and latched to housing 25 by latches 30. Drive pulley 52 is keyed to a first end of blender mixing shaft 40 and connected via suitable belts or gears to a motor power supply 53. In the illustrated preferred embodiment, mixing shaft 40 rotates in a clockwise direction to cause tools 68,68*a* and 69,69*a* to mix and move the blended ingredients from the area of the inlet chute toward outlet chute 34.

Coolant inlet 46, leading from a suitable pressurized coolant supply is secured to the end of coolant conduit 82 extending from blender mixing shaft 40 from the coolant connection box 44. A conventional sealed rotary joint valve connection is provided within connection box 44 for coolant inlet 46 and coolant conduit 82 to permit rotation of coolant conduit 82 with blender shaft 40. The returning coolant from the interior of blender mixing shaft 40 is expelled from mixing shaft 40 through spoked wheel 85 into coolant connection box 44 and exits through coolant outlet conduit 49 to a suitable coolant disposal unit 50.

When repair or replacement of the mixing tools 68,69 is indicated by visual inspection through access door 35, the reverse procedure is employed to remove blender mixing shaft 40 to gain access to the mixing tool(s) requiring repair or replacement. Complete disassembly of blender assembly is not normally required for repair or replacement of the internal parts due to the construction of the split end caps and bearing assemblies.

In operation, particulate ingredients are introduced into the cylindrical chambered housing 25 through inlet opening 32 while rotating the motor driven axial mixing shaft 40 at a predetermined RPM to create a plow-like mixing action by the plurality of elongated mixing tool members. A resin, or other suitable particulate binding material, is added through the inlet opening 32 simultaneously with the particulate ingredients and during continued rotation of the motor driven axial mixing shaft, as needed. The continuous plow-like tool mixing action, with the individual mixing tools acting as individual wedges moving through the particulate ingredients and particulate binding material, forms a homogeneous mass. This homogeneous mass of particulate ingredients and particulate binding material is recovered through the exit opening at the second end of the cylindrical chambered housing and employed to make a particle or fiber board final product. The plow-like mixing action is operable in small increments to transport and, at the same time, to disrupt mass flow.

Although the invention has been described relative to specific embodiments, it is not so limited and there are numerous variations and modifications thereof that will be apparent to those skilled in the art in the light of the above teachings. For example, although the mixing tools have been shown and described as having a specific relative angular relationship, this angular relationship can be varied between adjacent tools so as to provide back and forth mixing action movement to result in longer retention time for the blending mixture within the blender, when so desired.

It is therefore to be understood that, within the scope of the appended Claims, the invention may be practiced other than as specifically described herein.

What is claimed as new and desired to be secured by Letters Patent of the United States is:

1. A blender for uniformly mixing solid particles with an adhesive to blend the mixture into a unitary mass, comprising in combination:

a unitary elongated tubular blender housing;

said blender housing having first and second oppositely disposed open ends;

a first end cap for closing said first open end of said blender housing, and a second end cap for closing said second open end of said blender housing;

a plurality of latch means for releasably securing said first and said second end caps in sealed relationship, respectively, to said first and said second oppositely disposed open ends of said blender housing;

each of said plurality of latch means including a first portion attached to said blender housing and a second portion attached to one of said first and said second end caps;

inlet means provided adjacent said first end of said blender housing for receiving a quantity of solid particles and a supply of adhesive therefor for mixing in said blender housing;

outlet means provided adjacent said second end of said blender housing to provide an exit for the blended solid particles and adhesive from said blender housing after mixing thereof;

a removable elongated, hollow, mixing shaft extending through said first and said second end caps and said blender housing;

said elongated mixing shaft having a first end supported by and extending through a first bearing assembly;

a drive pulley keyed to said first end of said hollow mixing shaft;

a power supply connected to said drive pulley serving to impart a drive force to said drive pulley and cause rotation of said mixing shaft;

said elongated mixing shaft having a second end supported by and extending through a second bearing assembly; and coolant means connected to the interior of said elongated mixing shaft to provide a coolant medium therein during a blending operation.

2. The blender of claim 1 wherein each of said first and said second end caps are formed of a pair of semicircular segments, each pair of said semicircular segments having contacting mating surfaces and said contacting mating surfaces being provided with tongue and groove connections.

3. The blender of claim 1 wherein said coolant means includes:

a coolant connection box attached to said second end of said elongated hollow mixing shaft for relative rotation therewith;

a coolant inlet conduit leading through said coolant connection box and extending along a portion of the length of said elongated hollow mixing shaft;

a pressurized coolant supply in fluid connection with said coolant inlet conduit; and a coolant outlet leading from said coolant connection box.

4. The blender of claim 3 wherein said coolant inlet conduit is provided with (a) a sealing disk disposed at a first end thereof and contained within said first end of elongated hollow mixing shaft and disposed at a point substantially coplanar with said first end cap; and (b) a spoked disk spaced from said sealing disk and disposed on said coolant inlet within said elongated hollow mixing shaft.

5. The blender of claim 3 wherein said elongated hollow mixing shaft is provided with a plurality of flat surface areas disposed along the circumferential length thereof;

said plurality of flat surface areas being arranged in diametrically disposed spaced pairs;

each of said diametrically disposed pair of flat surface areas being disposed ninety degrees from the next adjacent pair of flat areas;

each member of each pair of flat surface areas being provided with an opening therethrough to provide fluid communication between the inside and outside diameter surface areas of said hollow mixing shaft; and means connecting a hollow mixing tool to said hollow mixing shaft at each of said flat surface areas thereon.

6. The blender of claim 5 wherein said means connecting a hollow mixing tool to said hollow mixing shaft at each of said flat surface areas thereon comprises a plurality of U-clamps; each said U-shaped clamp having a flat surface to mate with one of said flat surface areas on said hollow mixing shaft; each said U-clamp further including outturned end portions having holes therein to align with holes provided on an oppositely disposed U-clamp about said hollow mixing shaft; bolt means extending through the aligned holes in oppositely disposed U-clamps and nut means attached to said bolt means to secure a pair of said oppositely disposed U-clamps together about the circumference of said hollow mixing shaft; each said U-clamp having an integrally formed hollow mixing tool extending therefrom, whereby when a pair of U-clamps are bolted together about the circumference of said hollow mixing shaft, a pair of hollow mixing tools extending from said pair of U-clamps will be disposed opposite to each other and at a substantially perpendicular relationship relative to the center axis of said hollow mixing shaft.

7. The blender of claim 6 including a compressible sealing washer disposed between each said flat surface on said hollow mixing shaft and said flat surface on each said U-clamp to provide a leak proof passageway between said mixing shaft interior and each said hollow mixing tool.

8. The blender of claim 6 wherein said coolant inlet conduit is provided with a plurality of openings through the exterior circumference thereof; said plurality of openings being arranged in diametrically disposed pairs and confined to the length of said coolant inlet conduit that is contained between said sealing disk and said spoked disk; each said pair of diametrically disposed openings being rotatably disposed ninety degrees from the next adjacent pair of openings; and each said member of said plurality of openings being disposed in alignment with one of said hollow mixing tools attached to said hollow mixing shaft.

9. The blender of claim 3 wherein each said hollow mixing tool is provided with a hollow interior having multiple angular surfaces extending along the length thereof.

10. The blender of claim 9 wherein the cross sectional exterior surface area configuration of each hollow mixing tool is selected from the group of configurations consisting of a triangle, a square, a diamond and a rectangle.

11. A blender for uniformly mixing solid particles with an adhesive to blend the mixture into a unitary mass comprising, in combination:

a unitary elongated tubular blender housing;

said blender housing having first and second oppositely disposed open ends;

a first end cap for closing said first open end of said blender housing, a second end cap for closing said second open end of said blender housing;

means releasably securing said first and said second end caps in sealed relationship with said respective first and second open ends of said blender housing; inlet means provided adjacent said first end of said blender housing for receiving a quantity of solid particles and a supply of adhesive therefor for mixing in said blender housing;

outlet means provided adjacent said second end of said blender housing to provide an exit for the blended solid particles and adhesive from said blender housing after mixing thereof;

a removable elongated, hollow, mixing shaft extending through said first and said second end caps and said blender housing;

said mixing shaft including a plurality of removable mixing tools disposed about the circumference thereof and confined to the length of said mixing shaft contained within said blender housing;

a first bearing assembly receiving and supporting a first end of said hollow mixing shaft and a second bearing assembly receiving and supporting a second end of said hollow mixing shaft;

said first and said second bearing assemblies being supported by respective first and second prongs of a U-frame;

said U-frame having a base segment integral with said first and said second prongs;

a pair of spaced semi-circular brackets secured to and extending from said base segment of said U-frame and disposed between said first and said second prongs of said U-frame;

said pair of spaced semi-circular brackets serving to contact and provide support to said blender housing;

a pair of spaced legs having a first end connected to said base of said U-frame;

a foot segment integral with and disposed at a second end of each of said spaced legs; and each said foot segment including means to provide fixed connection of said U-frame to a support surface.

12. The blender of claim 11 including an access door provided along a portion of the length of said blender housing;

latch means movable between an open and a closed position for releasably mounting said access door in sealed relationship with said blender housing; and handle means secured to said access door to permit complete removal of said access door from said blender housing when said latch means is disposed in an open position.

13. The blender of claim 11 wherein said elongated tubular blender housing is formed of a stainless steel and said first and said second end caps are formed of a material selected from the group of materials consisting of metals, metal alloys, and plastics.

14. The blender of claim 13 wherein said first and said second end caps are each formed of a pair of semicircular segments and each pair of semicircular segments having mating surfaces.

15. The blender of claim 14 wherein said mating surfaces on said semicircular segments are provided with tongue and groove connections.

16. The blender of claim 13 wherein said first and said second end caps are formed of stainless steel.

17. The blender of claim 13 wherein said first and said second end caps are formed of a durable plastic selected from the group of plastics consisting of a high molecular weight polypropylene, polyethylene, nylon and mylar.

18. The blender of claim 11 wherein said removable mixing tools disposed about the circumference of said mixing shaft consist of multiple pairs of hollow mixing tools disposed in diametrically opposed spaced pairs along the length of said hollow mixing shaft contained within said blender housing.

19. The blender of claim 18 wherein said hollow mixing tools are each provided with a multiple face angular interior surface extending along the length thereof.

20. The blender of claim 19 wherein the external cross sectional area of each said hollow mixing tool is selected from the group of cross sectional area configurations consisting of a triangle, a square, a rectangle and a diamond.

* * * * *